US005397900A

United States Patent [19]

Wetzler

[11] Patent Number: 5,397,900

[45] Date of Patent: Mar. 14, 1995

[54] WHEEL-ASSEMBLY MONITOR FOR DIAGNOSING PASSING RAILROAD TRAINS

[76] Inventor: Gerd R. Wetzler, Steige 12, 6906 Leimen, Germany

[21] Appl. No.: 67,836

[22] Filed: May 27, 1993

[30] Foreign Application Priority Data

May 29, 1992 [DE] Germany ..... 42 17 681.6

[51] Int. Cl.[6] ..... B61K 9/06

[52] U.S. Cl. ..... 250/342; 246/169 A; 246/169 D; 250/353

[58] Field of Search ..... 250/342, 353; 246/169 D, 169 A

[56] References Cited

U.S. PATENT DOCUMENTS

| | | | |
|---|---|---|---|
| 3,183,349 | 5/1965 | Barnes et al. | 246/169 D |
| 3,545,005 | 12/1970 | Gallagher | 246/169 D |
| 4,323,211 | 4/1982 | Bambara et al. | 246/169 A |
| 5,149,025 | 9/1992 | Utterback et al. | 246/169 A |

FOREIGN PATENT DOCUMENTS

| | | | |
|---|---|---|---|
| 397759 | 2/1966 | Switzerland | 246/169 D |

OTHER PUBLICATIONS

Advertisement in *Railway Signaling and Communications,* (Sep. 1961) p. 31.

*Primary Examiner*—Constantine Hannaher
*Attorney, Agent, or Firm*—Longacre & White

[57] ABSTRACT

A monitor to diagnose wheel assemblies of passing railroad trains, the monitor being characterized in that a cavity is present in and parallel to a measurement tie or in a hollow railroad tie, the cavity housing infrared deflection units and at least one infrared detector which make it possible to monitor all heat sources present in the vicinity of the wheel assembly and the undercarriage of the train car while offering maximum protection against mechanical and electrical factors. The wheel pressure and accelerator pickups introduced with the monitor allow accurate determination of the values needed to normalize the infrared test results such as wheel position, wheel weight and tread conditions.

19 Claims, 2 Drawing Sheets

WHEEL-ASSEMBLY MONITOR FOR DIAGNOSING PASSING RAILROAD TRAINS

BACKGROUND OF THE INVENTION a) Field of the Invention

The invention concerns a wheel-assembly monitor to diagnose passing train-cars for the purpose of detecting the temperature of the wheel-assembly axles, drive, braking and bearing components, and of other heat sources to be monitored on train-cars, in particular radiation sources supplied with heat by conduction from moving parts which are only indirectly accessible, or whereby the temperatures of these components can be inferred.

b) Description of Related Art

Infrared detection systems are used in railroad systems for monitoring heat sources. These systems are affixed to concrete foundations or to the railroad ties or rails and, in order to retain enough train clearance, they must be mounted outside the space subtended between the two rails; the track being formed by two rails supported by cross-ties.

The known detection systems, however, suffer from substantial drawbacks regarding the required number of track switches, the mandatory mountings, the susceptibility of mechanical and electrical influences, the constancy of detection configuration, the detectable wheel-assembly or components for one system per axle, and the electrical safety consideration of possible contact between the life-endangering voltages and the housings of the monitors.

Detection geometries subtending slopes >90° must be used with the conventional monitors mounted between the wheels of one assembly. This requires at least one additional track switch to define the measurement range. Moreover, the fixed measurement ranges can be only covered if, for instance, electromagnetic or eddy rail-brakes are in a position other than lowered, i.e. not in a braking position. Additionally, when the sun is low, its light may fall onto the system; triggering false alarms during train travel.

The mounting of the monitor weighing up to 50 kg to the rail, tie or concrete foundation is exceedingly laborious. The systems mounted to the rails or ties are susceptible to frequent mechanical disturbances and accordingly operation is reduced while maintenance is increased.

In such systems incurring vibrations or mechanical impacts for instance from parts loaded on and/or overhanging the cars, the measurement geometry of the monitor may be imperceptibly degraded and operational reliability may also be jeopardized. Therefore, plate guards must be installed to protect the monitors, as a result of which maintenance is substantially increase. In order to allow cable exchange even in times of frost, the cables are usually mounted off ground and on the superstructure. Hence such electrical connections are also frequently damaged.

Electrical safety against excessive high voltages (to the touch) heretofore could only be assured for the 220-volt rail-affixed monitors and for track layouts fitted with all-clear displays by using a detector connected to the particular rail. If ground is lost and the infrared detector housing is at voltage, the maintenance personnel is in lethal danger.

SUMMARY OF THE INVENTION

The object of the invention is to overcome these drawbacks and to create a monitor scanning an arbitrary component of a wheel-assembly and/or train car across the shortest possible measurement range. The measurement systems of the monitor is affixable anywhere parallel to the railroad tie, that is, also between the rails, and evinces invariant measurement geometries and further is insensitive both to electrical and mechanical factors.

The monitor of the invention is characterized in that the individual sources of infrared radiation of each train car and/or wheel-assembly are scanned several times in parallel by means of appropriately mounted deflection units, and in that the infrared radiation as a whole is collimated onto one or more infrared detectors.

The monitor may be housed in a measurement tie mounted parallel to the railroad ties or in a hollow railroad tie.

The individual deflection units are equipped with one or more sealing units through which the infrared radiation passes into the deflection unit. The deflection unit can deflect the infrared radiation and/or sample it and/or optically stop it up or down.

The infrared detector is also mounted in the measurement tie or in the hollow railroad tie and is able to receive and combine several signals. On account of the comparatively large spacing from the rails and because of the electrical shielding by a supporting metal bar, this detector is protected maximally against electromagnetic factors.

All supply and data lines are electrically and mechanically protected by the metal bar.

Because the systems is affixed to the rail in the vicinity of the tie and serves to sense the wheel compression and the acceleration of the rail or tie perpendicularly to the longitudinal rail axis, the wheel position can be determined accurately. Hence, the measurement range from axle to axle parallel to the track axis can be ascertained and adjusted, and the test results if called for can be post-corrected in a subsequent analyzer.

Accordingly, the temperatures of all components of wheel-assemblies and of various train cars, the total weight of the wheel-assembly, and the wheel loads are available at the analyzer.

In relation to the acceleration and wheel load values, test results are then available which shed light on the wheel conditions such as imbalances and tread damages which cause bearing damage.

Other features and advantages of the present invention will become apparent from the following description of the preferred embodiment, taken in conjunction with accompanying drawings, which illustrate, by way of example, the principles of the invention.

DETAILED DESCRIPTION OF THE PREFERRED EMBODIMENT

The following description of the present invention is not to be taken in a limiting sense, but is made merely for the purpose of illustrating the general principles of the invention. The following description presents the best contemplated mode of carrying out the invention.

Figure 1:
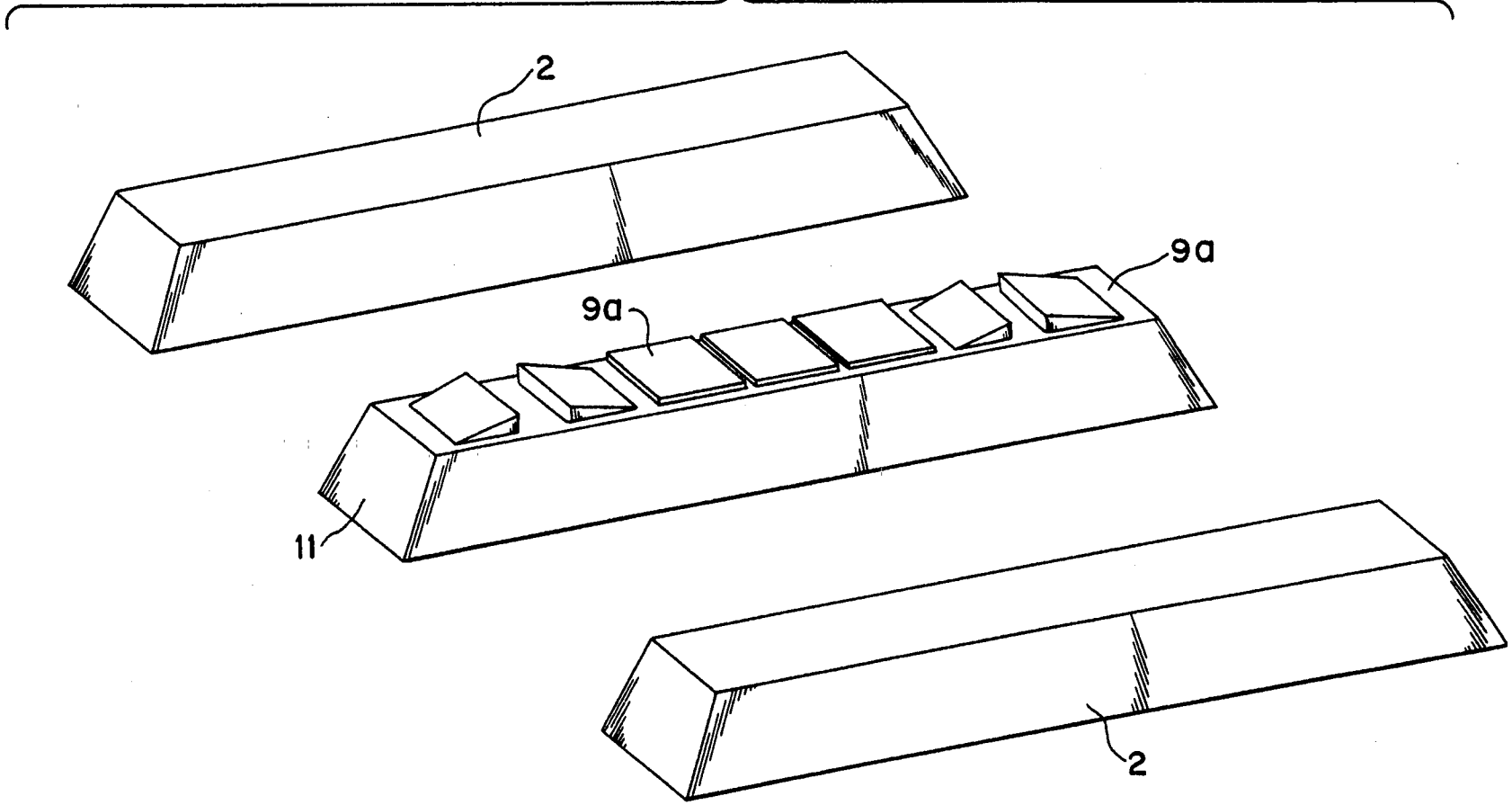
FIG. 1 schematically and in perspective shows a hollow railroad tie between and parallel to two conventional railroad ties.

FIG. 1 shows a hollow railroad tie 11 between two regular ties 2 and housing both the deflection units 9 and the infrared detector 15. FIG. 1 also shows the sealing units 9*a* covering the deflection units and which may serve to eliminate outside interference with the measurement values. The sealing units are preferably electrically driven, movable, sealing units mounted directly on the deflection units 9.

The deflection units 9 are formed in collimated manner and serve to receive the infrared radiation generated by the components of the wheel-assembly. It should be noted that deflection units 9 have appropriate dimensions to ensure that the detection of all components of the wheel-assembly can be implemented using an infrared-optical system. The deflector units 9 collimate the radiation signal and deflect the same to the infrared detector 15.

Figure 2:
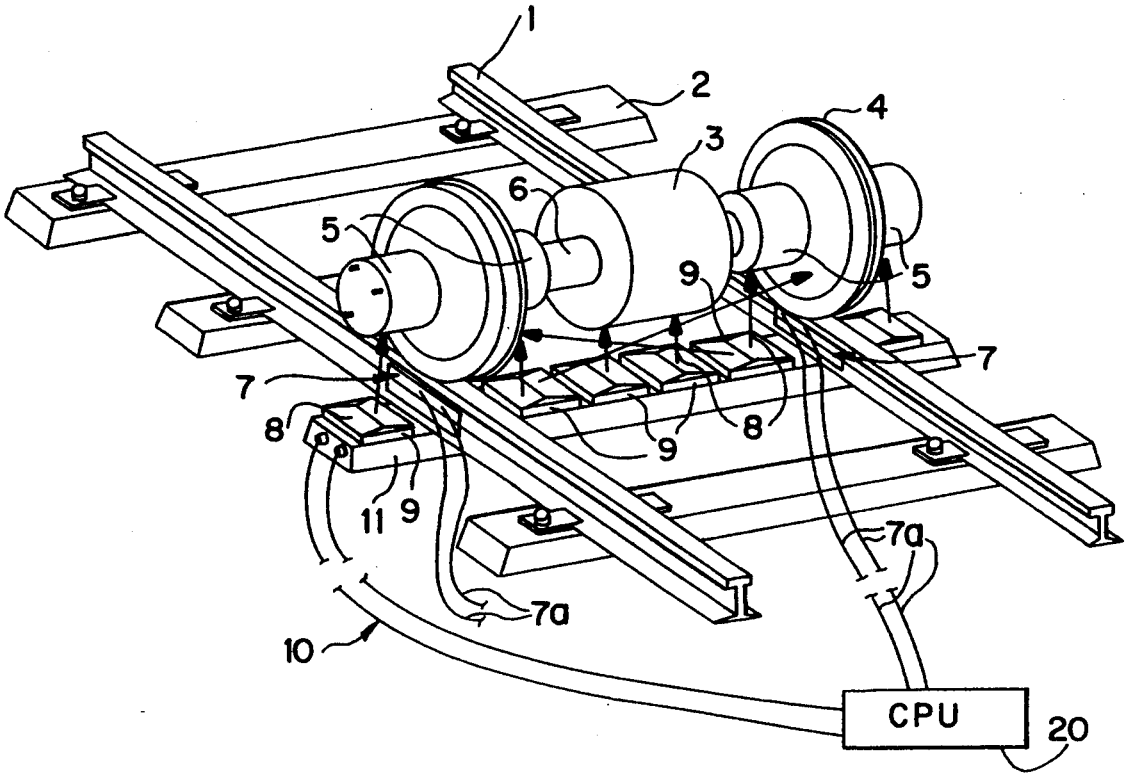
FIG. 2 is a perspective view of the construction of the monitor in a hollow tie and the wheel assembly including drive motor, inside and outside wheel assembly bearings, and brakes.

FIG. 2 shows a wheel-assembly riding on the rails 1 resting on the ties 2 and consisting of wheels 4, the wheel axle 6 and the wheel-assembly bearings 5. The axle 6 furthermore supports the drive motor 3.

Acceleration sensors 7 are mounted on the two rails 1 and are connected through their terminals 7*a* to the analyzer 20. The acceleration sensors 7 detect the wheel compression and the acceleration of the rail or tie perpendicular to the longitudinal rail axis. Therefore, the wheel position can be determined accurately, and the measurement range from axle to axle parallel to the track longitudinal axis can be ascertained and adjusted. These measurement values can be sent to the analyzer 20 for post correction of the test results.

Cables 10 connecting the detector to the analyzer 20 exit from the end face of the hollow tie 11 as shown in FIG. 2.

Figure 3:
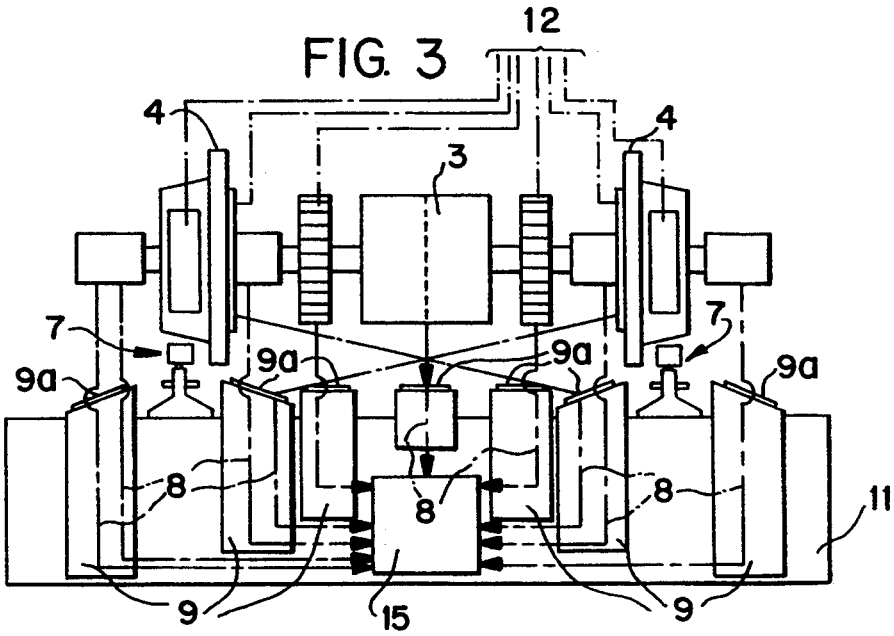
FIG. 3 is a vertical cross-section of the wheel assembly through the hollow tie, and schematically shows the infrared path from source to detector.

The path of the various test rays (i.e. the measurement geometry) is shown by the arrows 8 of FIG. 3. The arrows 8 represent the infrared radiation from the various components of the drive assembly, for example, the drive motor 3, the wheels 4, the wheel-assembly bearings 5. Additionally, FIG. 3 shows all the components of the conventional braking systems such as shoe, shaft-disk and wheel-disk brakes, which are denoted by reference numeral 12. Arrows again denoted by 8 and representing the infrared radiation issue from these heat generating components through the deflection units 9 to the infrared detector 15.

The detector 15 transduces the infrared into an electric output which furthermore is amplified. The electrical output is transmitted via cables 10 to the analyzer 20 which may be a computer processing unit for analyzing and storing test results.

It should be noted that the path of the various test rays (i.e. the measurement geometry) as shown by the arrows 8 of FIGS. 2 and 3, are determined by the arrangement of the deflection units. With reference to FIG. 2, four deflection units 9 are positioned between the rails 1, while FIG. 3 illustrates an arrangement wherein five deflection units 9 are positioned to receive infrared radiation between the rails 1.

The infrared detector 15 is positioned within the measurement tie 11 to collect the radiation data passing into and from the deflection units 9, wherein the radiation data may be collected and/or combined, then transposed into an electric output before being sent to the analyzer 20.

From the foregoing, it is understood that the temperatures of all heat generating components of the wheel assemblies and of various train cars, the total weight of the wheel assembly, and the wheel loads are available at the analyzer or CPU 20. In relation to the acceleration and wheel load values, test results are then available which indicate wheel conditions such as imbalances and tread damages which cause bearing damage.

While the invention has been particularly shown and described with reference to a preferred embodiment, it will be understood by those having ordinary skill in the art that various changes in form and detail may be made therein without departing from the spirit and scope of the invention.

I claim:

1. A monitoring and measurement system for detecting operational characteristics of a wheel/axle assembly mounted on a railed vehicle, said system comprising:

a tie member supporting a pair of substantially parallel rails upon which a railed vehicle translates;

at least one infrared deflection unit mounted in a collimated manner, and adapted to receive and collimate infrared radiation from said wheel/axle assembly;

an infrared detection means for receiving collimated infrared radiation from said at least one deflection unit, said infrared detection means being positioned between said parallel rails, wherein said collimated infrared radiation is transduced into electrical signals representing the wheel/axle assembly's temperature and operational characteristics, wherein said deflection unit is mounted in said tie member.

2. The monitoring and measurement system of claim 1, further comprising at least one position sensing means mounted on said rail for generating a position signal representing a position of said wheel/axle assembly, said position signal being interfaced with said electrical signal to further detect the operational characteristics of said wheel/axle assembly.

3. The monitoring and measurement system of claim 1, further comprising an acceleration sensor mounted on said rail for detecting an acceleration of said wheel/axle assembly and generating an acceleration signal.

4. The monitoring and measurement system of claim 3, further comprising an analyzer means for receiving said electrical signal and said acceleration signal, whereby said analyzer analyzes said electrical signal and said acceleration signal to determine the wheel/axle assembly's operational characteristics.

5. The monitoring and measurement system of claim 4, wherein said at least one infrared deflection unit, said detection means, and said analyzer are rigidly mounted in said tie member.

6. The monitoring and measurement system of claim 4, wherein said at least one infrared deflection unit, said detection means, and said analyzer are mounted in said tie member so as to be damped against vibration.

7. The monitoring and measurement system of claim 1, further comprising a sensor means mounted on said rail for detecting said wheel/axle assembly's weight, and generating a weight signal.

8. The monitoring and measurement system of claim 7, further comprising an analyzer means for receiving said electrical signal and said weight signal, whereby said analyzer analyzes said electrical signal and said weight signals to determine the wheel/axle assembly's operational characteristics.

9. The monitoring and measurement system of claim 1, wherein a dimension of said tie member in a longitudinal direction of said rail is such that all components of said wheel/axle assembly can be monitored using an infrared-optical system.

10. The monitoring and measurement system of claim 1, wherein said infrared detection means is mounted in said tie member.

11. The monitoring and measurement system of claim 1, wherein said at least one infrared deflection unit receives a train-car infrared radiation signal, said train-car being mounted on said wheel/axle assembly.

12. The monitoring and measurement system of claim 1, wherein said at least one infrared deflection unit comprises an electrically driven, movable, sealing unit for selectively permitting infrared radiation to enter said at least one infrared deflection unit.

13. The monitoring and measurement system of claim 1, wherein said tie member comprises dimensions similar to a standard tie for railed vehicles, and is installed transversely to a longitudinal direction of said rail.

14. A monitoring and measurement system for detecting operational characteristics of a wheel/axle assembly mounted on a railed vehicle, said system comprising:

a tie member supporting a pair of substantially parallel rails upon which a railed vehicle translates, said tie member being at least partially hollow and extending in a longitudinal direction;

at least one infrared deflection unit mounted in said tie member, and adapted to receive and collimate infrared radiation from said wheel/axle assembly;

an infrared detection means mounted in said tie member for receiving collimated infrared radiation from said at least one deflection unit, wherein said collimated infrared radiation passes from said at least one infrared deflection unit to said detection means within said hollow tie member.

15. The monitoring and measurement system of claim 14, wherein said at least one infrared deflection unit receives said infrared radiation at positions both outside and between said pair of rails with respect to said longitudinal direction.

16. The monitoring and measurement system of claim 14, wherein said at least one infrared deflection unit is positioned between said pair of rails with respect to said longitudinal direction.

17. The monitoring and measurement system of claim 14, wherein said infrared detection means is mounted between said pair of rails.

18. The monitoring and measurement system of claim 14, wherein said at least one deflection unit receives said infrared radiation from below said wheel/axle assembly with respect to a direction of gravity.

19. A monitoring and measurement system for detecting operational characteristics of a wheel/axle assembly mounted on a railed vehicle, said system comprising:

a tie member supporting a pair of substantially parallel rails upon which a railed vehicle translates;

at least one infrared deflection unit mounted in a collimated manner, and adapted to receive and collimate infrared radiation from said wheel/axle assembly, said at least one infrared deflection unit being positioned between said parallel rails;

an infrared detection means for receiving collimated infrared radiation from said at least one deflection unit, wherein said collimated infrared radiation is transduced into electrical signals representing an operational characteristic of the wheel/axle assembly; and at least one additional infrared deflection unit mounted outside said pair of rails, said at least one additional infrared deflection unit adapted to receive and collimate infrared radiation from said wheel/axle assembly and deflect the infrared radiation to said detection means.

* * * * *